United States Patent [19]

Simonton et al.

[11] 4,108,417

[45] Aug. 22, 1978

[54] BATTERY POST AND CONNECTOR STRAP MOLD

[75] Inventors: Robert D. Simonton, Fremont; Carl D. Schultz, Tiffin, both of Ohio

[73] Assignee: Dale Products, Inc., Fremont, Ohio

[21] Appl. No.: 600,203

[22] Filed: Jul. 30, 1975

[51] Int. Cl.[2] ..... B22D 27/04; B22D 23/04; B22D 25/04; B22D 35/04

[52] U.S. Cl. ..... 249/81; 164/133; 164/332; 164/348; 249/102; 249/119

[58] Field of Search ..... 164/332, 333, 133, 337, 164/137, DIG. 1, 348; 29/204; 249/119, 129, 155, 81, 102

[56] References Cited

U.S. PATENT DOCUMENTS

| | | | |
|---|---|---|---|
| 2,735,148 | 2/1956 | Shannon et al. | 164/DIG. 1 |
| 3,565,162 | 2/1971 | Farmer | 164/337 |
| 3,718,174 | 2/1973 | Hull et al. | 164/333 X |

*Primary Examiner*—Francis S. Husar
*Assistant Examiner*—Gus T. Hampilos
*Attorney, Agent, or Firm*—David H. Wilson

[57] ABSTRACT

There is disclosed a mold assembly for casting posts and plate connector straps onto stacks of plates of lead acid type batteries wherein molten metal is circulated through one or more channels in the assembly and selectively damned to overflow into adjacent mold cavities. Cycle time and properties of the posts and connector straps are improved by constructions which impart a large thermal mass to the channel walls and a small thermal mass to the mold cavity walls. Thermal isolation of the mold cavity walls from the channel walls further enhances these conditions whereby the molds can be elevated in temperature prior to the casting operation and rapidly cooled during that operation. Cooling of the post mold cavities earlier and at a faster rate than the strap mold cavities increases post strength. A mold frame construction containing the molten metal flow channel and one or more inserts for the frame provide the desirable thermal properties while lending flexibility to the apparatus. Coolant circuits are provided for the inserts with flow paths which influence the sequence and speed of cooling of mold insert portions.

14 Claims, 12 Drawing Figures

FIG. 1
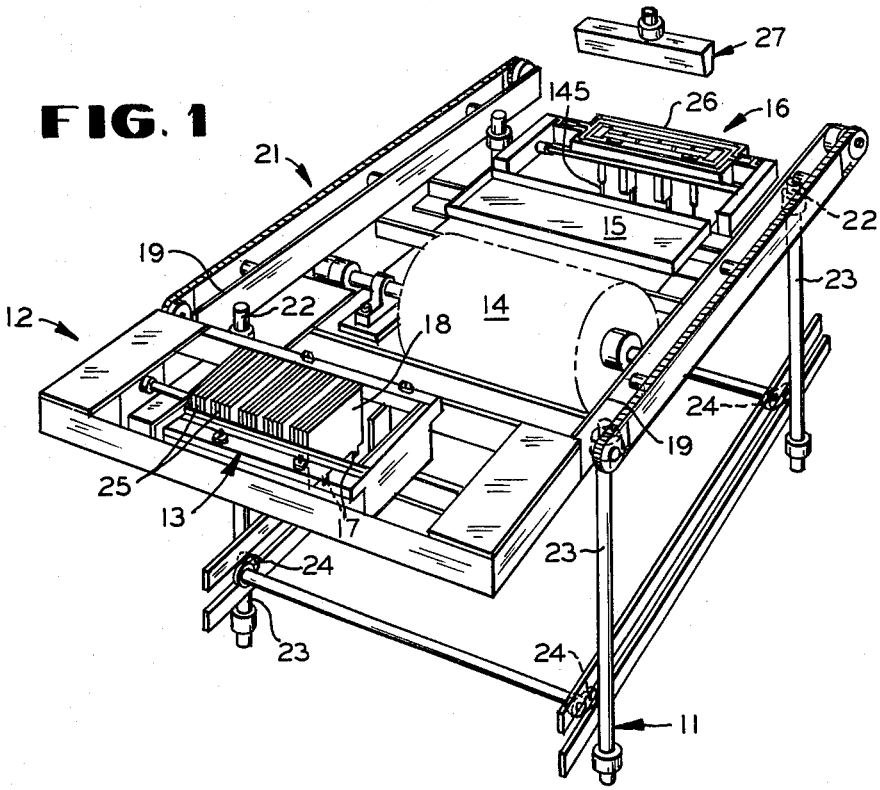
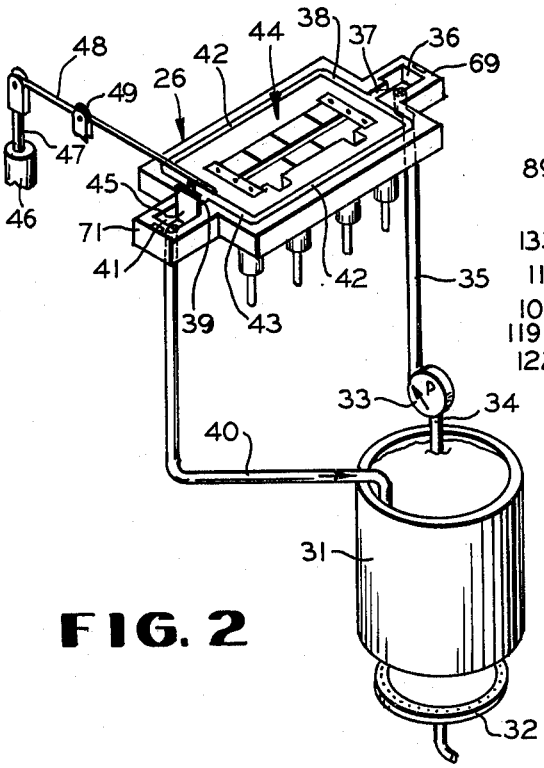
FIG. 2
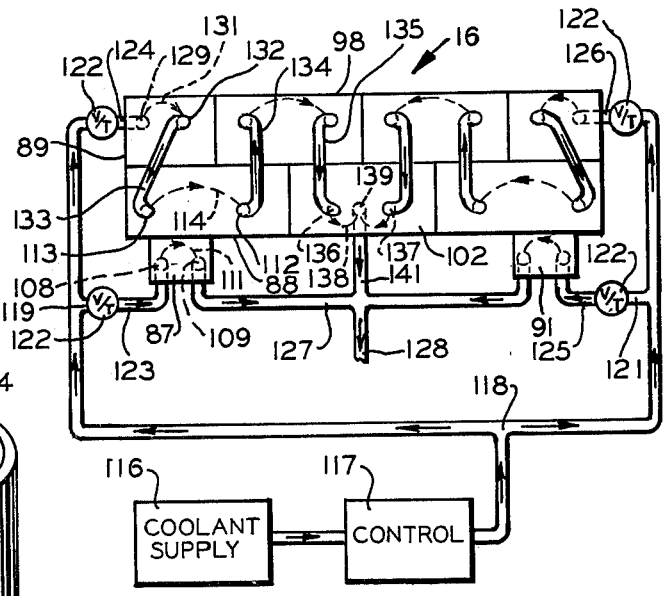
FIG. 7

BATTERY POST AND CONNECTOR STRAP MOLD

BACKGROUND OF THE INVENTION

This invention relates to improvements for battery strap and post cast-on machines of the type disclosed in U.S. Pat. Nos. 3,718,174 and 3,802,488 respectively issued Feb. 27, 1973, and Apr. 9, 1974, both of which issued to Donald R. Hull and Robert D. Simonton. In those machines, stacked battery plates and separators for a plurality of cells making up a lead-acid storage battery have the respective connection lugs on the positive and negative plates of each cell interconnected by a cast-on strap and an intercell connecting post or terminal post cast as an integral portion of each strap. These casting operations are accomplished simultaneously with the cells inverted but otherwise oriented as they are to be in the finished battery structure. Stacked cell elements are clamped with the plate lugs extending downward. A plurality of properly oriented mold cavities are preheated as by directing a gas flame over them. Molten metal, usually containing a large proportion of lead, is circulated continuously along a channel next to the cavities and the flame which is reducing also preconditions the upper surface of the metal. When desired conditions are achieved, the molten metal level is raised to overflow wiers between the channel and each mold cavity to fill the cavities, the molten metal is then permitted to recede, the flame is removed, and the clamped cell assemblies are positioned to immerse a portion of the plate connecting lug on each plate in the molten mass in an appropriate connector strap cavity. The cavities are then chilled, as by flowing water through the body of the mold, and when the molded straps and posts solidify adequately they are extracted from the mold with the plates fused thereto.

A procedure as outlined above should be accomplished in repetitive cycles for efficient commercial utilization. Cycle time should be reduced to a minimum. It has been found that a substantial portion of the cycle time is involved in the heating and cooling of the mold body. Further, where the molten metal flow channels are in the mold assembly, the channel walls should not be chilled to such a degree that the metal flow is impeded during the freezing of the straps and posts. This required some degree of precision in the temperature control of the mold assembly. It has been found desirable to cool the posts, particularly the terminal posts, at least as rapidly as the less massive straps since the slower cooling of the posts tends to result in mechanically weak terminals. Accordingly, greater control of localized temperature in the mold assembly than has been available heretofore is desirable.

Mold expense is a significant factor in machines of the type under consideration. It has been difficult to obtain suitable castings in which mold forms can be produced. The variety of cell and terminal arrangements required for lead-acid batteries has further complicated mold construction.

In accordance with the above, an object of this invention is to improve mold assemblies for battery strap and post cast-on machines.

A second object is to decrease cycle time of battery strap and post cast-on machines.

A third object is to reduce the cost of mold assemblies.

A fourth object is to increase the control of localized thermal conditions in mold assemblies.

SUMMARY OF THE INVENTION

The above and other objects have been realized by the invention of mold assemblies in which the mold cavities are formed in bodies which are separable from a frame body for the assembly. In one embodiment the cavities are in a plurality of modules which are constructed to minimize the metal mass in the vicinity of the cavity walls. Coolant passages are arranged in close proximity to the post cavities and the strap cavities with the coolant flow arranged to pass the post cavities before reaching the strap cavities. Coolant inlets to the assembly immediately precede the terminal post coolant passages to insure initial cooling of the terminal posts. Coolant path interconnections between the modules are provided while module interfaces are arranged to be in excellent heat transfer relationship to each other yet thermally isolated from the frame. Module indexing means are provided to accurately position the height of the modules within the mold assembly frame.

Marginal flow channels for the molten metal are provided in one embodiment of the mold assembly. The molten metal flows around the perimeter of the assembly in a split path from one longitudinal end to the other. This concentrates the region in which heating and cooling is extreme and permits closer spacing of plate connecting straps and cell connecting and terminal posts in the finished battery.

Another embodiment wherein advantageous heat transfer relationships are achieved with reduced mass in the material defining the mold cavities and close proximity of the coolant flow paths to the cavity walls includes a generally hollow, fabricated, mold insert fitting into a mold frame. The insert is machined to the desired cavity forms on one face and to a single cavity on the opposite face from the bottom of which bosses extend for the mold cavities. Baffel plates are provided in the single cavity to establish desired coolant flow paths. The open face of the single cavity is closed as by a plate welded to the insert around its perimeter and to the bosses so that knockout pins can enter the bottom of the mold cavities without contact with the coolant.

BRIEF DESCRIPTION OF THE DRAWINGS

FIG. 1 is a partially broken away schematic perspective view of the operating elements of the apparatus in which the mold assemblies of this invention are utilized;

FIG. 2 is a perspective view of the molten metal flow path associated with the apparatus of FIG. 1 including the container for such metal, a typical mold assembly with marginal flow channels, a mold insert and a mold frame according to this invention, and the molten metal filling control;

FIG. 7 is a schematic diagram of coolant flow patterns in the modular cavity insert assembly of FIGS. 3 through 6;

DETAILED DESCRIPTION OF THE PREFERRED EMBODIMENT

Figure 3:
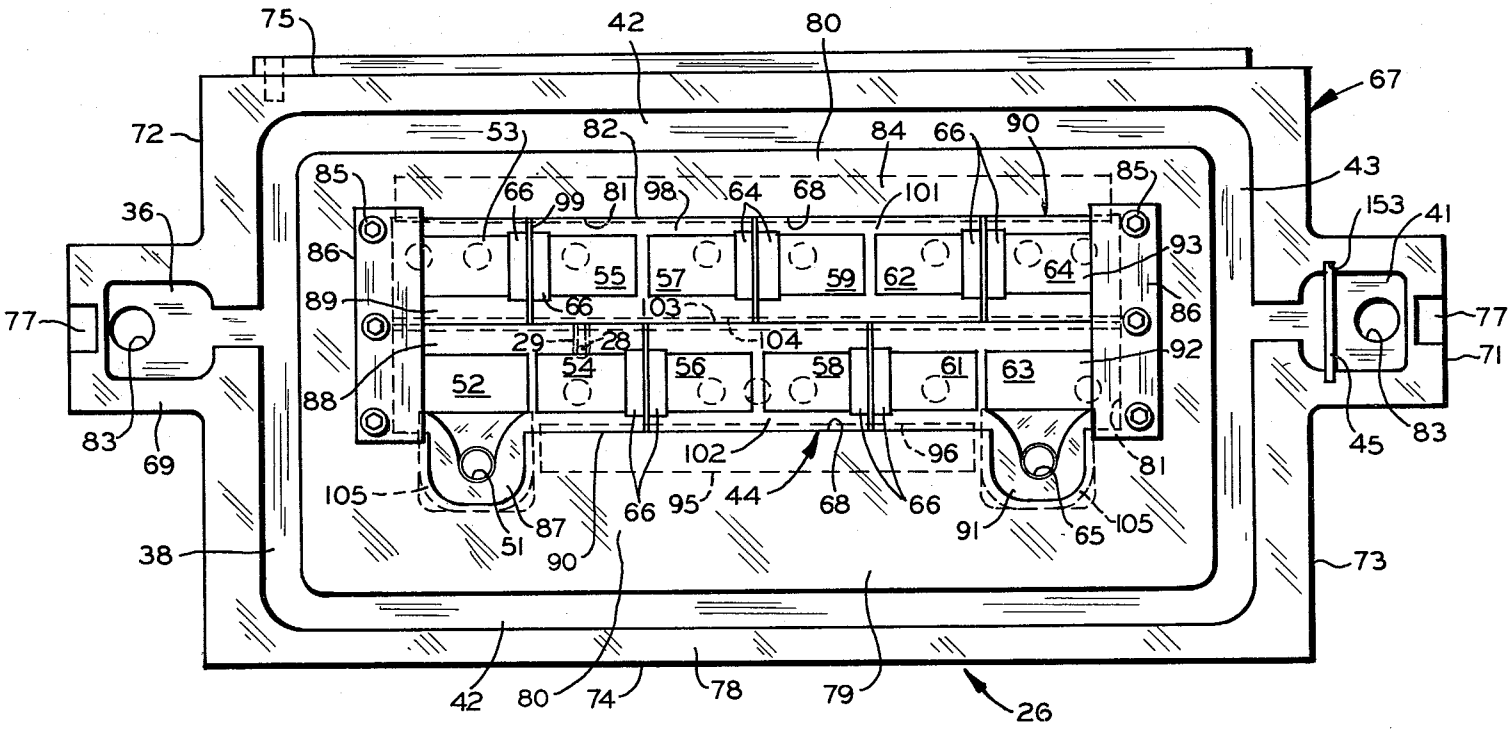
FIG. 3 is a plan view of a mold frame having marginal flow channels and modular mold inserts.

An apparatus in which the mold assembly of this invention is utilized is disclosed in FIG. 1 as comprising a base support 11 having a transfer station 12 for loading and unloading lead-acid battery cells, a plural cell clamp and carriage 13, a lug burnishing station 14, a lug fluxing station 15, a cast-on station 16. Controls (not shown) for the apparatus are automatically or semi-automatically operated to advance the carriage 13 through a cycle from the transfer station 12 through the burnishing, fluxing and cast-on stations and back to transfer station in proper timing and sequence to result in casting cell straps on the lugs 17 of the positive and negative battery plates 18 of each cell to connect those respective lugs electrically and mechanically and to form intercell connector lugs or battery terminal posts (not shown) in appropriate spatial relationship for placement in a battery case.

The apparatus includes guide rails 19 and drive means 21 for carriage 13 mounted on an elevating mechanism comprising corner rods 22 telescopically mounted in base, leg tubes 23 and reciprocally driven therein by cams 24. Stacks 25 of interleaved positive and negative battery plates with suitable separators are mounted with their lugs extending downward in carriage 13 and clamped therein, typically by a machine operator actuating manual controls. When all cells are mounted the carriage is elevated in the transfer station 12 and advanced at a level to carry the lugs 17 through a rotating burnishing brush in burnishing station 14. The carriage then advances to a position above fluxing station 15, is stopped and lowered to dip the lugs 17 in a fluxing solution. It is then raised and permitted to drain.

At an appropriate point in the cycle of machine control, the mold assembly 26 is preconditioned for casting by heating and deoxidizing by directing a somewhat reducing gas flame over the surface of the assembly from a burner head 27. Burner head 27 is mounted on an elevator (not shown) so that it is lowered the appropriate preheat interval ahead of the next cast-on operation and the flame increased to condition the mold and lead surface therein. When the temperature desired is achieved, as may be sensed by a thermocouple 28 in the slot 29 milled in the bottom of the mold insert of FIG. 6, the flame from burner 27 is reduced to a standby level and the burner head elevated to clear the cast-on station 16.

Carriage 13 is advanced in its elevated condition from the fluxing station to the cast-on station 16 and when above the cast-on station lowered toward the mold assembly 26 to immerse lugs 17 in molten lead in the mold cavities for the connector straps.

Coolant is circulated through jackets around the mold cavities to freeze the posts and straps and when an appropriate temperature has been achieved the cast post and straps are extracted from their molds by simultaneous operation of extractors driven by a knock-out plate in synchronism with the carriage elevator. The cell units with strap and post are then returned along an elevated path to clear the fluxing station 15 and burnishing station 14 to the transfer station 12 where, for example, the machine operator releases the group of cells from the carriage. In one arrangement an inverted battery casing is placed over the upstanding bottoms of the plate stocks 25 and the carriage 13 is inverted so that the straps and posts are on the uppermost edge of the cells and the battery case (not shown) is maintained below and partially enclosing the clamped group of cells as they are released so they fall in place into the case.

The cast-on process outlined utilizes a mold filling technique illustrated in FIG. 2. A container 31 for lead is heated as by heater 32 to maintain the lead molten. Molten lead is circulated through the mold assembly by a pump 33 with a suction line 34 immersed in the lead and a feed line 35 coupled to an input sump 36. From the sump 36 the lead flows through an input throat 37 to a channel 38 in communication with an output throat 39 to an output sump 41 and thence to a return line 40 to the container 31. The channel 38 splits the flow of molten metal to flow through longitudinal perimeter channels 42 and a joining end channel 43 to output throat 39 whereby lead flows around the perimeter of the array 44 of mold cavities in mold assembly 26. When it is desired to fill the mold cavities, a gate 45 is closed across output sump 41 so that the continued flow of molten metal into input sump 36 raises the level of the molten metal until it overflows the longitudinal perimeter channels 42 into the mold cavities. Outer walls of the channels, throats and sumps are elevated to prevent overflow of the molten metal from the mold assembly 26 and gate 45 can be arranged to permit overflow of the metal to output sump 41 in the event an excess of molten metal is supplied while the gate is closed.

Apparatus for gate control is represented by a solenoid 46 coupled by a rod and clevis 47 to a beam 48 pivoted at 49 and carrying the gate 45 at its opposite end. The system controls are arranged (by means not shown) to close the gate to fill the mold cavities by overflow filling and then open the gate to establish the desired elevation of the molten metal in the mold cavities sufficiently ahead of the lowering of lowering of lugs 17 into the cavities to avoid excessive immersion of those lugs.

It will be appreciated from the preceding discussion that a substantial degree of precision of control of thermal conditions are required at the cast-on station 16. The channels, throats and sumps must not be cooled to a degree which would freeze off flow of the molten metal. The cavities must be cooled sufficiently to solidify the metal for extraction in the form of straps and post. The molten metal in the cavities cannot be so hot at the time the lugs 17 are immersed that they detrimentally affect the overlying cell assemblies 25 as by melting the plates, separators, of the lugs above the region of immersion. However, the molten metal must have sufficient heat to fuse the straps to the lugs without weak mechanical bonds or high resistance electrical interfaces. In addition to the heating and cooling of the posts, particularly the terminal post should be controlled for strength purposes such that freezing of the posts is initiated prior to or at least contemporaneously with the freezing of the frequently thinner cast strap structures. This greater cooling of the posts has been found particularly desirable with certain molten metal compositions. All of the above thermal considerations should be met in a short time to provide a short machine cycle and increased machine productivity.

Figure 4:
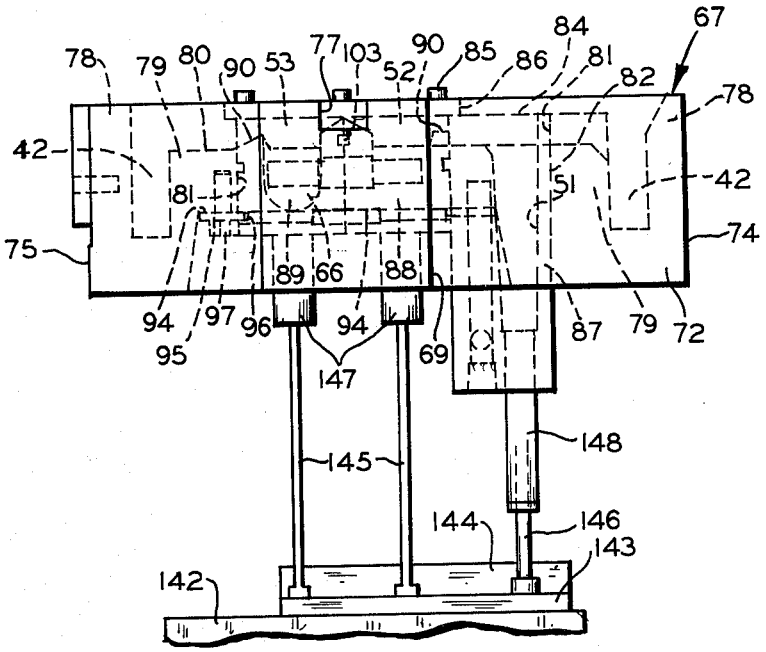
FIG. 4 is an end view taken from the left hand end of FIG. 3.

One form of mold assembly which affords the desiderata set forth is shown in FIGS. 3 and 4. Mold cavities for a six cell battery are shown including cavities for a negative terminal post 51, a first cell negative strap 52 and a positive strap 53, a second cell positive strap 54 and negative strap 55, a third cell negative strap 56 and positive strap 57, a fourth cell positive strap 58 and negative strap 59, a fifth cell negative strap 61 and positive strap 62, a sixth cell positive strap 63 and negative strap 64, and a positive terminal post 65. The cavities 51 and 65 for the terminal post are continuous with the cavities 52 and 63 of the first and sixth cells for the connector straps of the appropriate polarity. All other connector strap cavities include an intercell connector post cavity 66 adjacent a similar post cavity for the strap of opposite polarity for the next cell whereby the connection of adjacent connector posts connect the battery cells in series electrically.

Thermal, mechanical and fabricating advantages are realized by arranging the mold assembly 26 as a frame 67 having an open center 68 which receives one or more mold cavity inserts. In FIGS. 3 through 6, the mold cavity inserts are modularized for individual terminal post cavities 51 and 65 and for the connector straps 52 through 64. Frame 67 comprises end bosses 69 and 71, ends 72 and 73 and sides 74 and 75. A mounting cavity 77 is provided in each of the bosses to enable the frame to be clamped in the cast-on station 16 by means (not shown) and sumps 36 and 41 and channels 38, 42 and 43 are formed in the frame. Frame 67 can be cast and machined to its final form. In practice the walls of the channels in which the molten metal flow paths are formed for circulation of the metal are relatively massive, as the outer walls 78 and inner walls 79, so that they are relatively stable in temperature during the thermal cycling of the mold inserts and the walls of the mold cavities. Outer walls 78 are higher than inner walls 79 to contain the molten metal in the assembly 26 while permitting overflow of molten metal across runoff surface 80 and over weir 90 inward when the gate 45 is closed. The open center 68 is formed to provide a receptacle for the mold inserts which at its upper surface is fitted closely enough to avoid the leakage of molten metal as it rises to flood the region of the interface between the inner perimeter 81 of the frame and the outer sides 82 of the inserts. The frame 67 is machined to its final dimensions to provide simultaneous overflow filling of the several mold cavities and suitable molten metal tight mating and fastening surfaces.

Bores 83 are tapped for pipe couplings to the feed and return lines 35 and 40. The reduced thickness of the inner or web portion 84 of the frame is bored and tapped on its upper surface to receive cap screws 85 which retain seal plates 86 against the upper face of web 84 and of the end mold inserts 87, 88, 89, 91, 92 and 93. The lower face of web 84 is also machined at 94 to receive a lock plate 95 fitting a keyway 96 in each mold insert. Bores tapped for screws 97 are provided in surfaces 94 to retain the lock plates 95.

Modular mold inserts are arranged in two longitudinal rows. They are separated along those rows at adjacent connector post cavities 66. Thus as viewed in the upper row of FIG. 3 insert 89 has its post cavity 66 adjacent to insert 98 having a left-hand post cavity 66 separated therefrom by a cell divider 99. Insert 98 includes two strap connector cavities and two connector post cavities since no intercell connector post is required in the upper row between the second and third cells. Similarly, inserts 101 and 102 include two connector strap cavities.

Alignment of inserts 89, 98, 101 and 93 of the upper row, and inserts 88, 102, and 92 of the lower row is established and maintained by a key 103 fitted into longitudinally centered keyway 104 between the upper and lower rows and by locking plates 95 fitting into outer keyways 96 of the upper and lower rows. Terminal post cavity inserts 87 and 91 are clamped between seal plates 86 bearing against the upper face 105 of the inserts and lock plate 95 bearing against lip 106 where the distance between face 105 and lip 106 is the same as that between the upper faces of the other inserts and the upper lip of lock plate receiving keyway 96.

Figure 5:
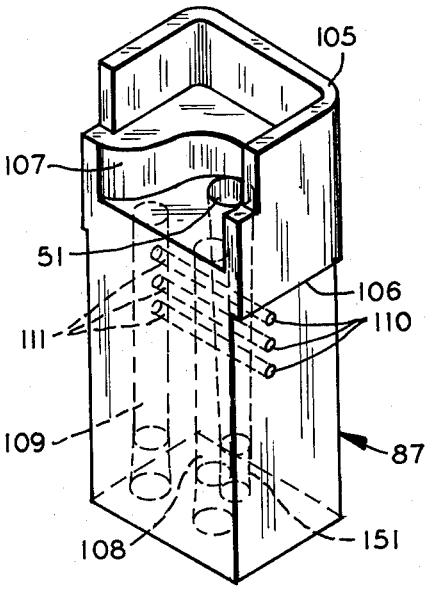
FIG. 5 is a perspective view of a terminal post module or insert for the assembly of FIGS. 3 and 4.
Figure 6:
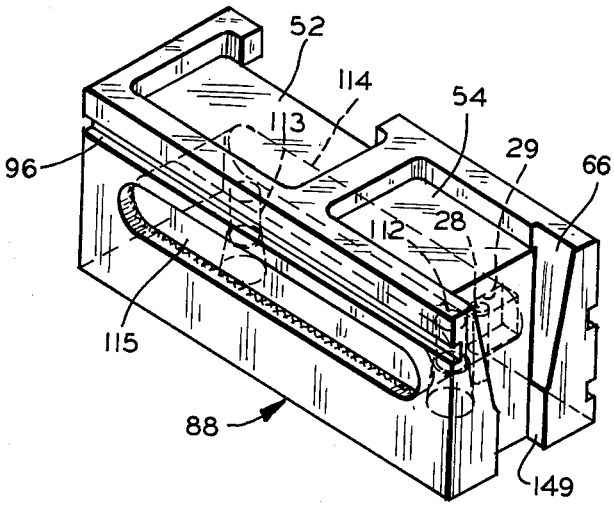
FIG. 6 is a perspective view of an insert or module for a terminal strap and a strap of opposite polarity with an intercell connector.

The adjacent faces of the inserts are machined flat to provide intimate contact and therefore high heat transmission between inserts. Coolant is supplied to each insert through a circuit individual to each. These circuits are made up of a plurality of intersecting bores and cavities with certain of the bores provided with individual tapped regions for the reception of pipe couplings. The walls between the coolant passages and the mold cavity in each insert are relatively thin, ranging from about one-eighth to five-sixteenths of an inch and usually about one quarter of an inch in thickness and no metal-to-metal interfaces between the primary passages and the cavities are permitted in order to insure rapid heat transfer from the cavities when coolant is introduced into the passages. Coolant inlets and passages are best seen in FIGS. 5 and 6 for typical inserts 87 and 88. In insert 87 an elongate terminal cavity 51 and a cavity 107 for a base portion integral with the terminal and coupling it to the connector strap formed in cavity 52 of insert 88 are in close proximity to coolant passages 108 and 109 paralleling the length of the terminal cavity and interconnecting coolant passages 111 paralleling the bottom of cavity 107. The lower portions of the bores forming passages 108 and 109 are tapped to receive pipe couplings communicating with the coolant supply and controls. The outer ends of bores 111 are pluged as at 110. The connector strap cavities and intercell connector post cavity 66 are similarly in close proximity to coolant passages in insert 88 of FIG. 6. There bores 112 and 113 extend from the underside of the insert into the milled slot 114 extending over much of the length of insert in a position closely adjacent and essentially coincident with a projection of cavities 52 and 54 into the depth of the insert. This coolant jacket is closed by a bar like filler insert 115 in the side of mold insert 88 as by a weld bead. It will be noted that bore 112 is closely adjacent the cavity 66 to efficiently cool that cavity. Again the outer portions of bores 112 and 113 are tapped to accommodate threaded pipe couplings.

The coolant circuit shown in FIG. 7 is arranged to maximize the cooling effect on the terminal cavities by introducing the cold coolant at these bores for those passages. The coolant is also passed serially through half the inserts in two parallel circuits which parallel the terminal coolant circuits and is withdrawn from a central region. A supply of coolant 116 is passed through a coolant control 117 which initiates and terminals the flow of coolant and, if desired, admits a flow of a drying gas from a source (not shown) following completion of the coolant flow in accordance with the sequencing of the machine controls. Flow paths are shown split at T 118 and again at T*s* 119 and 121. Throttle valves 122 are provided to each mold assembly input 123, 124, 125 and 126 to control the amount of coolant passed through the inserts or mold modules. An input flow path 123 and 125 is individual to each terminal module 87 and 91 so that the coolant flows along the terminal columns in passages 108 and 109, beneath the terminal strap cavity 107 in passages 111 and through outlet line 127 to outlet 128. The lug connector strap cavity walls are cooled by collant flow as from input path 124 through a bore 129, a milled cavity 131 and a bore 132 in insert 89, through connector tube 133 to insert 88 and its passages 113, 114 and 112 to connector tube 134, thence to insert 98 through its coolant passages to connector tube 135 to insert 102. Coolant flow is illustrated by the arrows in FIG. 7. In insert 102 the coolant flows from each end passage 136 and 137 through the milled internal cavity 138 to the central exit passage 139 and then to outlet line 141.

As in the case of the exemplary modules 87 and 88 of FIGS. 5 and 6, coolant cavities are provided in the bodies in close proximity to their mold cavity walls as by locating milled cavities close to the bottom of the strap cavities and the bores from the bottom sides of the inserts to the milled cavities close to the intercell connector posts.

Another consideration in the insert construction and placement of coolant passages and conduits is the need for knockout pins into the deep cavities of the mold inserts. As best seen in FIG. 4, a knockout table 142 is located beneath the mold assembly 26 and is coupled to the carriage elevating mechanism (by means not shown) to be lifted in synchronism with the lifting of the carriage 13 and the cell stacks 25 after the straps and posts have been cast.

An ejector back-up plate 143 is mounted on the knock-out table and supports an ejector plate 144 from which ejector pins 145 and 146 extend upward in registry in the horizontal plane with each of the intercell connector post cavities 66 and from which terminal post ejector pins 146 extend upward in registry with the terminal post cavities 51 and 65. Ejectors 147 and 148 conforming to the uppermost face of the intercell connector posts and terminal post respectively are secured as by a threaded connection into tapped bores on each ejector pin 145 and 146. Ejectors 147 and 148 enter passages 149 and 151 as shown in FIGS. 5 and 6 extending from the under surface of the inserts to the bottoms of the post cavities 66, 51 and 65. The ejector assembly is arranged to provide clearance for all coolant connector tubes 133, 134 and 135 and external connections.

It will be noted from the above description that the mold assembly of FIGS. 3 through 6 provides a stable base frame which in the perimeter filling arrangement offers a substantial mass of high thermal capacity for the continuously fed molten metal and a group of mold inserts or modules which are thermally isolated from the frame yet clamped together for effective thermal conductivity between each other. An arrangement has been illustrated in FIG. 7 which insures controlled and effective cooling of the terminal posts and rapid cooling of all cavity walls for short cycle times. Alternative cooling arrangements are also contemplated with the modular mold structure. Further interchange of mold inserts is available conveniently as by the replacement of a failed or worn insert or the substitution of a different cavity form. Thus terminal forms can be altered without changing the connector straps and posts.

Modular mold assemblies can be arranged with individual coolant inputs from the collant supply 116 to each moduel where greater speed or more precise control of relative cooling in the individual modules is desired. They also can be arranged with the terminal post modules connected in a serial coolant circuit with the remainder of the assembly so that the cold coolant is initially applied to the passages of the terminal posts and thereafter passed through the connector strap and post modules.

In practice the modular mold assembly is formed by machining the rough frame casting to form the finished frame 67 with the desired open center configuration 68 for accommodating mold inserts and the desired molten metal flow channel configuration for the perimeter channels or a central channel as the case may be. Inserts are then formed to their external finished dimensions over their mounting and mating faces and their reference surfaces including keyways 96 and 104 and lip 106 are formed. Then the coolant passages are milled, bored and tapped and the construction apertures closed as by welding in filler plates 115 and closing the ends 110 of bores 111. The inserts are then machined for their terminal and connector post cavities 51 and 66 and the ejector passages 151 and 149 to those cavities. Inserts are then keyed together and mounted in the frame for machining of their upper faces and final machining of the adjacent frame surfaces.

The upper surface of the mold assembly should be generally horizontal to insure uniform flow of molten metal to all cavities when gate 45 is closed and the metal level is raised. As best seen in FIGS. 2 and 4, the surfaces over which the molten metal flows include the bottoms and sides of the sumps, throats and channels 36, 37, 38, 39, 41, 42 and 43. When gate 45 is dropped in its guide slots 153 to close off flow to return line 40, the molten metal level rises above inner wall 79 to flow onto upper surface 80 and over weir 90 into cavities for straps and terminal and connector posts. The level of the molten metal does not exceed the upper limit of outer wall 78 since gate 45 permits its overflow to outlet sump 41 before that occurs. After filling is complete for example as determined by a timer set for the rate of molten metal flow, the gate 45 is raised, the molten metal level recedes and that metal in the molds is maintained at a level determined by the height of weirs 90. It is to be appreciated that the final machining of the mold faces and the heights of the cell dividers 99 establish laterial limits on the cavities of the various straps and posts at least as high as the weirs 90, so that upon the receding of the molten metal each strap puddle is distinct from all other puddles and the puddles freeze in individual, mechanically and electrically isolated straps.

Figure 8:
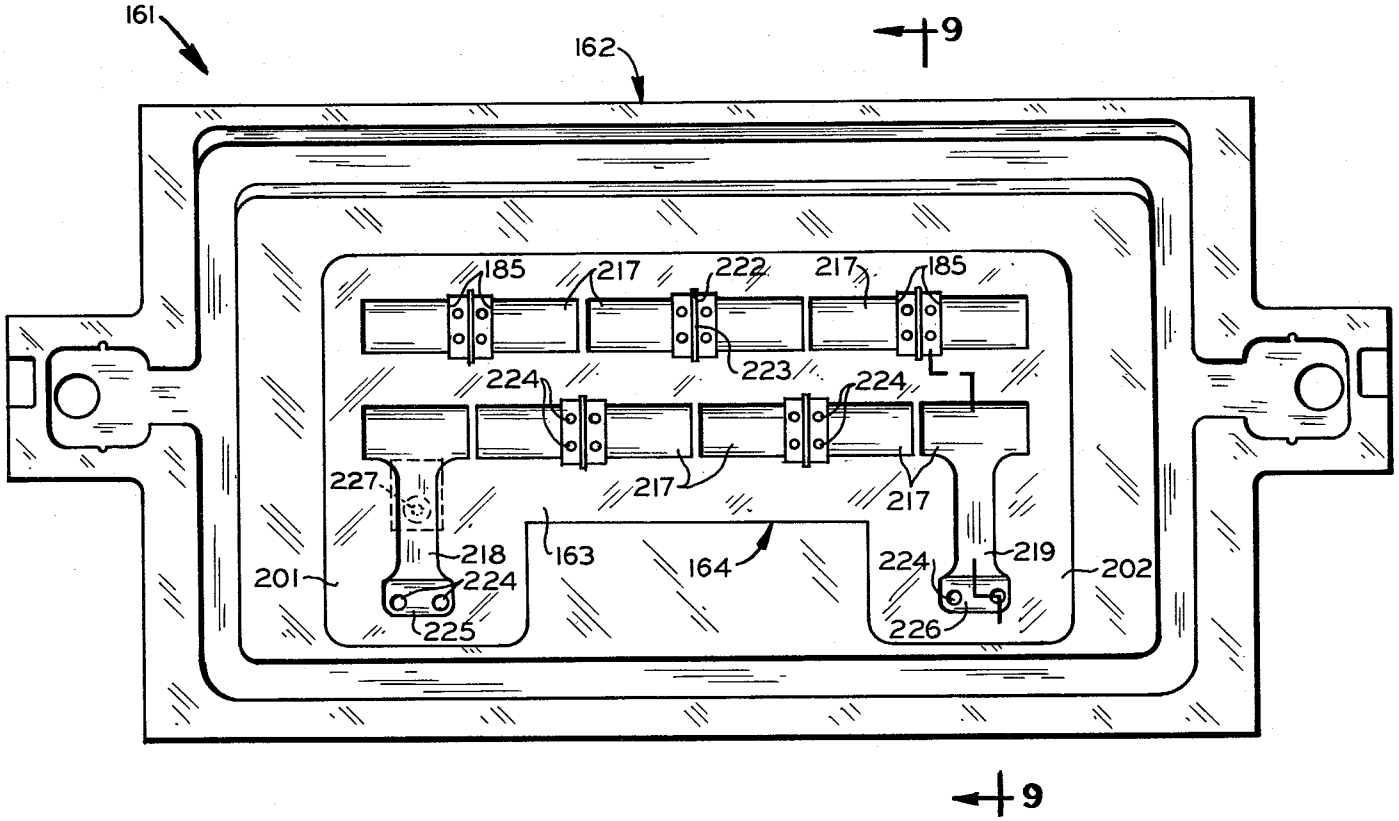
FIG. 8 is a plan view of a mold assembly utilizing a multiple cavity mold insert mounted in a mold frame illustrative of another embodiment of this invention.
Figure 11:
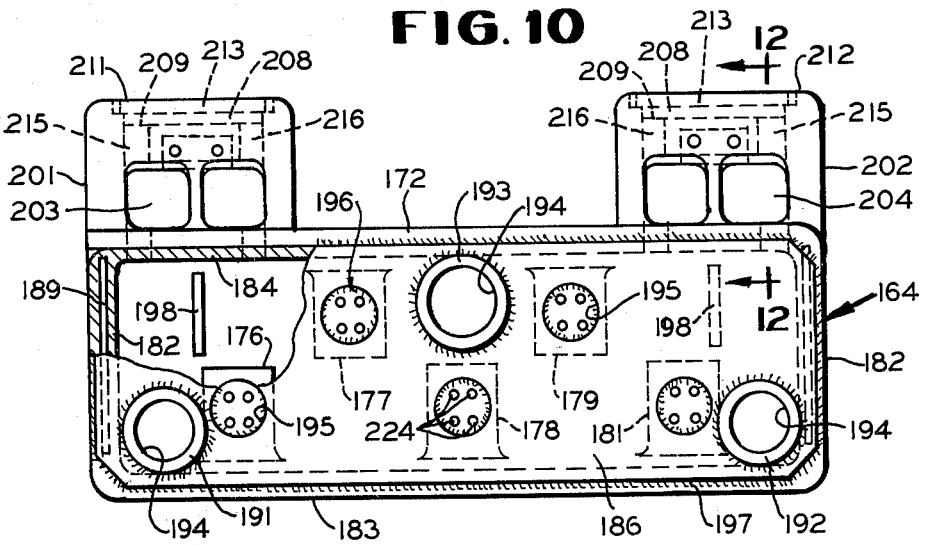
FIG. 11 is a plan view of the bottom of the mold insert of FIGS. 8 through 10 with portions broken away to reveal internal details of the construction.

FIGS. 8 through 11 disclose another form of mold assembly which provides effective thermal cycling for the cast-on techniques described. This mold assembly 161 has a frame 162 which can be formed from the same casting as frame 67 of FIGS. 3 through 6. The open center 163 of frame 162 is formed to accommodate a manifold type of mold insert 164 which is fabricated as a unit containing the twelve connector strap cavities, ten intercell connector post cavities and two terminal post cavities of a six cell storage battery. Since the terminal posts to be formed are for a side terminal battery in the illustrated embodiment, the plan outline of open center 163 and insert 164 contain terminal extensions as best seen in FIGS. 8 and 11. The assembly includes the extractors for each post cavity formed as paired knockout pins 165 and 166 for the connector posts and terminal posts respectively and driven by an upper and lower ejector plate 167 and 168 from knockout table 142. Insert 164 is secured to the frame by lock plates 169 and cap screws 171 into the frame. Perimeter overflow filling of the molds is utilized with perimeter flow channels, sumps, throats and a gate of the general form discussed with respect to FIGS. 3 through 6 and therefore assigned the same reference characters. Surfaces over which the molten metal flows are machined to provide the desired matches with insert 164 to carry the molten metal to and from the region of the mold cavities.

Manifold insert 164 is a single water jacketed body fabricated from a suitable material such as a block 172 of cold drawn machine steel which is machined from its front or upper face 173 to form the mold cavities and from its rear or lower face 174 to form a water jacket or coolant flow path. More particularly, the block 172 is milled from its lower face 174 to a depth which leaves an upper face wall thickness adequate for the milling of connector strap cavities, for example in a 1.500 inch thick block it can be milled 1.000 inch deep to an inner face 175 of generally rectangular form having bosses 176, 177, 178, 179 and 181, end walls 182 and side walls 183 and 184. Bosses 176 through 181 provide material in which connector post mold cavities 185 are formed from upper face 173 as by electric discharge machining.

The rear wall 186 of the mold insert water jacket is formed by a plate having keyways 187 formed in each end to register with keyways 188 in endwalls 182. Keys 189 are fitted into keyways 187 and 188 to align plate 186 whereby externally threaded sleeves 191, 192 and 193 welded to the outer face of plate 186 in registry with apertures 194 provide couplings for coolant input lines at 191 and 192 and an exhaust line at 193. Plate 186 is also apertures at 195 in registry with each of bosses 176, 177, 178, 179 and 181 where apertured 195 are within the projections of the respective bosses to enable a weld bead 196 to be laid around the inner wall of each aperture 195 in sealing relation to the lower face of the registering boss. A sealing weld bead 197 is also laid around the perimeter of plate 186 to seal the water jacket by sealing plate 186 to the walls 182, 183 and 184. Before application of plate 186 to block 172, coolant directing baffels 198 are tack welded to the inner face 175 to cooperate with bosses 176 and 181 in directing the in-flow of coolant toward the terminal extensions 201 and 202 whereby a substantial flow of cold coolant is applied to the terminal cavity regions as in the embodiment of FIGS. 3 through 6. Other coolant paths to the main body cavity are available as between the wall 183 and boss 176, between 176 and baffel 198 and between baffel 198 and wall 184.

Coolant cavities 203 and 204 are formed in close proximity to the terminal post cavities of extensions 201 and 202 by milling into the rear face 205 of the extensions and closing that face with a filler insert plate 206 sealed, as by weld bead 207, to the wall of the milled cavities. A slot 208 milled to a depth 209 in each of the distal faces 211 and 212 of extensions 201 and 202 provides a coolant passage around the outer side of the terminal post cavities with a closure plate 213 forming its outer wall when sealed by weld bead 214. Bores 215 and 216 extend into faces 211 and 212 and through main cavity sidewall 184 to provide inlet and exit coolant passages communicating with the main coolant cavity on the input and exit sides respectively of baffels 198.

Figure 9:
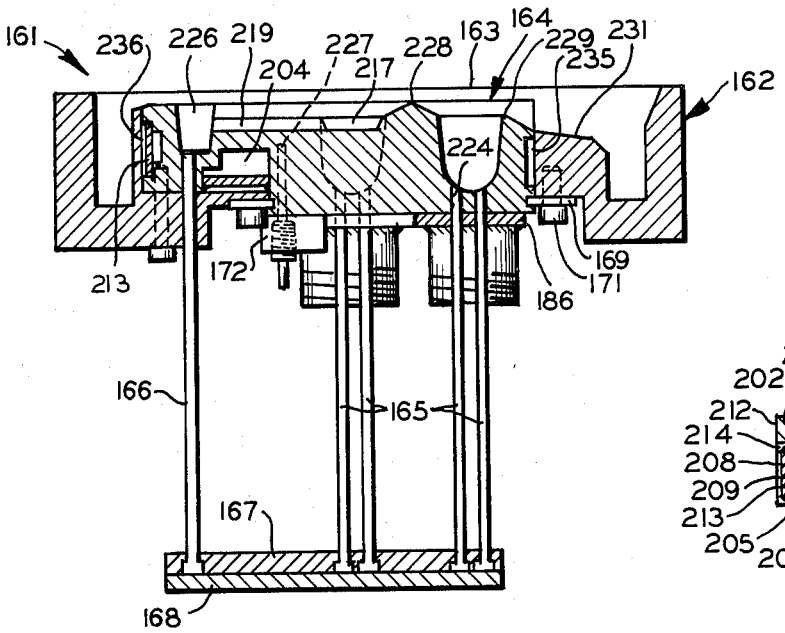
FIG. 9 is a cross-sectional view of the assembly of FIG. 8 taken along line 9—9 thereof.
Figure 12:
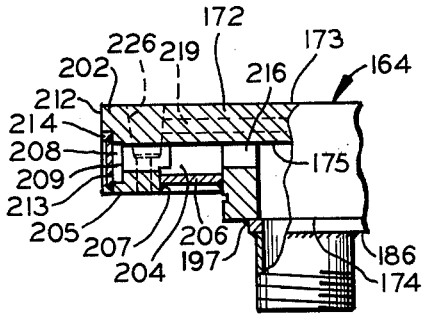
FIG. 12 is a sectional view of a side terminal mold portion illustrating the coolant passages therein and taken along the line 12—12 of FIG. 11.
Figure 10:
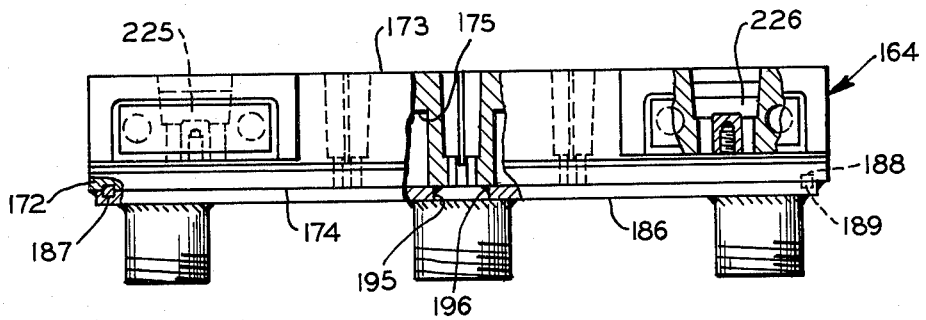
FIG. 10 is a side elevation view of the mold insert of FIGS. 8 and 9 with broken away portions to show details of the construction providing coolant jacketing in close proximity to the walls defining mold cavities.

The mold cavities are formed in the upper face 173 of block 172 by milling strap cavities 217 in the planar form shown in FIG. 8 and of the cross-section shown in FIG. 9. Cavity legs 218 and 219 for the negative and positive terminal posts extend along the face of extensions 201 and 202 and can be formed by milling. The intercell connector post cavities 185 are of the form of cavities 66 of FIGS. 3 through 6 and are formed in pairs in bosses 176, 177, 178, 179 and 181 so that they do not break through the boss walls and into the coolant cavity. Electric discharge machining permits these cavities to be formed with precision from face 172 such that one suitably tapered cavity can have a central groove 222 transverse of the longitudinal dimension of the insert into which is placed a divider plate 223 to separate the machined cavity into the two spaced separate cavities 185. Paired bores 224 for reception of knockout pins 165 extend normal to the general major plane of the manifold insert 164 through the bosses 176, 177, 178, 179 and 181 and into each of the connector post cavities 185. Thus, the cavity walls are in close proximity to the coolant for rapid cooling being spaced from the coolant only by the thickness of the remaining wall portions of their respective bosses.

Terminal post cavities 225 and 226 are formed at the ends of leg cavities 218 and 219 so that they extend below coolant cavities 203 and 204 and bores 215 and 216 whereby water is circulated around all sides of cavity 225 in extension 201 and similarly around cavity 226 in extension 202. In addition cavities 203 and 204 are close to the under surface of leg cavities 218 and 219 to rapidly enable the transmission of heat to the coolant from those cavity walls.

A thermocouple pocket 227 is located in block 172 close to the undersurface of leg cavity 218 and between coolant cavity 203 and the main coolant cavity whereby a thermocouple can be located close to the mold cavities for machine control purposes.

The embodiment of FIGS. 8 through 11 lends itself to convenient manufacture by milling the major face contours of the block 172, as the dividing ridge 228 between the aligned connector strap cavities, the weirs 229 adjacent each connector strap cavity and the runoff surfaces 231 from the weirs to the flow channels for the molten metal. Thin walls and substantial contact areas between the coolant and the walls insure rapid cooling of the cavities and the metal therein. Simple frame castings which have at least a substantial range of application to different molds and do not require the degree of perfection and freedom from flaws that has been dictated previously where mold cavities were formed in the castings can be employed. Thus, the mold assemblies are more trouble-free and superior than those disclosed in the aforenoted patents.

The thin walls of the manifold insert 164 particularly in the portions of that insert in which the mold cavities are formed offers the advantage of relatively low thermal mass in the mold cavity walls. Further, the separation of the sidewalls of bosses 176, 177, 178, 179 and 181 from the side wall of the inner perimeter of frame 162 increases the cooling rate for the intercell connector mold cavities. The substantial volume of the coolant passages around the terminal post mold cavities 226 enhances their cooling rate. Voids over much of the interface region between the side walls of the insert 164 and the frame 162 as at 235 of FIG. 9 tend to isolate the hot and large thermal mass of frame 162 from the thermally cycled insert 164. Similar voids can be provided on the terminal extensions 201 and 202 as shown in FIG. 9 at the space 236 between closure plate 213 and the frame.

It is to be appreciated that other forms of mold assemblies offering the advantage of maintaining a base structure such as frame 162 and the flow channel for molten metal contained in that base above the melting temperature of that metal while cycling the temperature of insert bodies containing mold cavities between a temperature above and below the melting temperature of the molten metal are within the concepts of this invention. That is, a base structure containing a molten metal flow channel can be arranged to have mold bodies maintained adjacent the base with the upper margins of the flow channel in molten metal flow communication with the upper margins of mold cavities so that upon elevation of the upper surface of the molten metal in the flow channel above the channel margins it will overflow into the cavities. Such arrangements by virtue of the base to insert interface resistance to heat flow, and/or the provision of voids or other thermal barriers in that interface region, even while maintaining a molten metal overflow surface between the base and insert, tends to thermally isolate the insert from the base and enable its rapid thermal cycling.

Further enhancement of thermal cyclcing of the insert and mold cavity is realized by reducing its thermal mass relative to the thermal mass of the base and by providing means to selectively circulate coolant through the insert while the base is free of coolant passages and relatively stable in its temperature. In the example, a base blank for a frame type base has major body dimensions about two inches by eight inches by fourteen and a half inches with end bases about two inches wide and an inch and three quarters long. The walls of the flow channel are relatively thick with bottom walls and outer side walls about one half inch thick and the inner side walls varying in thickness to accommodate the insert or inserts. The inserts on the other hand have relatively low thermal mass and thin walls between the coolant passages and the mold cavities. In the embodiment of FIGS. 8 through 12 the insert is about an inch and a half thick, about three and a half inches wide and nine and three quarters inch long in the primary rectangular section with terminal extensions 201 and 202 about $1\frac{1}{4}$ inches thick, and $1\frac{1}{2}$ by $2\frac{1}{2}$ inches. Most walls in this insert are about $\frac{1}{4}$ inch thick.

The hollow form of insert of FIGS. 8 through 12 can be modified in many forms to provide intimate relationships between the coolant flow paths and the mold cavity walls. The preferential cooling of the terminal molds might be accomplished by providing coolant inputs at the extensions 201 and 202 rather than the baffles and bosses illustrated as directing flow to their cooling passages. Additional baffeling or input ports for coolant can be utilized.

While overflow filling of the molds from perimeter channels has been shown, it is to be understood that an internal channel might also be incorporated in this mold assembly construction. Other connector strap, connector post, and terminal post structures or combinations can be formed in this type of construction. Alternative assembly techniques and structures wherein mold cavities and coolant cavities are separated by thin walls and formed in bodies of low thermal mass having thermal isolation from bodies of relatively large thermal mass containing flow channels for molten metal are contemplated within this invention. Accordingly, the above disclosure is to be read as illustrative of the invention and not in a restrictive sense.

We claim:

1. A mold assembly for casting elements onto storage battery plates comprising a base having a contoured upper surface including a generally horizontal flow channel having an inlet and an outlet spaced apart along the length of said channel for guiding the flow of molten metal along essentially the entire length of said channel between said inlet and outlet, a perimeter wall contiguous to portions of said flow channel of a first height sufficient to constrain molten metal under normal operating conditions of said assembly, a runoff surface contiguous to portions of said flow channel having a second height less said first height whereby the assembly is adapted to pass metal over said runoff surface when the level of molten metal in said channel is raised above said second height and below said first height under normal operating conditions of said assembly, said base being free of mold cavities in which elements are cast; an insert having at least a portion of each of a plurality of mold cavities in its upper surface and adapted to be mounted adjacent said base and separable therefrom, said mold cavities for the elements to be cast being entirely contained upon said insert; means mounting said insert contiguous with said runoff surface; said insert having a contoured upper surface in molten metal flow communication with said runoff surface and being in molten metal tight mating relationship thereto; a heat flow barrier means between said base and said insert; said base having a large thermal mass whereby molten metal flowing in said flow channel is maintained molten; said insert having a small thermal mass relative to that of said base in the portion thereof defining walls of the mold cavities; and a coolant jacket integral with said insert and extending over a majority of the underside of said upper surface upon which said mold cavities are contained whereby molten metal in said cavities can be solidified by admission of coolant to said insert jacket without cooling said base to a degree impeding the flow of molten metal in said flow channel.

2. A mold assembly according to claim 1 wherein said base is free of coolant passages in the body thereof.

3. A mold assembly according to claim 1 wherein said barrier means is characterized as a void.

4. A mold assembly according to claim 1 including a second insert having at least a portion of each of a plurality of mold cavities in its upper surface and adapted to be mounted adjacent said base and separable therefrom, said mold cavities for the elements to be cast being entirely contained upon said second insert; means mounting said second insert contiguous with said runoff surface; said second insert having a contoured upper surface in molten metal flow communication with said runoff surface and being in molten metal tight mating relationship thereto; and a heat flow barrier means between said base and said second insert; said second insert having a small thermal mass relative to that of said base in the portion thereof defining walls of the mold cavities; and a second coolant jacket integral with said second insert and extending over the preponderance of the underside of said upper surface of said second insert upon which said mold cavities are contained whereby molten metal in said cavities can be solidified by admission of coolant to said second insert jacket without cooling said base to a degree impeding the flow of molten metal in said flow channel.

5. A mold assembly according to claim 1 wherein at least certain of said plurality of mold cavities are discrete and spaced apart.

6. A mold assembly according to claim 1 wherein the depth of at least a first one of said mold cavities is greater than at least one other of said mold cavities; and means for preferentially directing coolant to portions of said coolant jacket proximate said first one of said mold cavities.

7. A mold assembly for casting elements onto storage battery plates comprising a base frame having an aperture through its thickness and having a contoured upper surface including a generally horizontal flow channel having an inlet and an outlet spaced apart along the length of said channel for guiding the flow of molten metal along essentially the entire length of said channel between said inlet and outlet, a perimeter wall contiguous to portions of said flow channel and contiguous to the outer limits of the upper surface of said frame of a first height sufficient to constrain molten metal under normal operating conditions of said assembly, a runoff surface contiguous to portions of said flow channel and said aperture having a second height less than said first height whereby the assembly is adapted to pass molten metal over said runoff surface when the level of molten metal in said channel is raised above said second height and below said first height under normal operating conditions of said assembly, said base being free of mold cavities in which elements are cast; an insert having at least a portion of each of a plurality of mold cavities in its upper surface and adapted to be mounted in said aperture of and adjacent said base frame and separable therefrom, said mold cavities for the elements to be cast being entirely contained upon said insert; means mounting said insert adjacent said base and contiguous with said runoff surface; said insert having a contoured upper surface in molten metal flow communication with said runoff surface and being in molten metal tight mating relationship thereto; a heat flow barrier means between said base and said insert; said base having a large thermal mass whereby molten metal flowing in said flow channel is maintained molten; said insert having a small thermal mass relative to that of said base in the portion thereof defining walls of the mold cavities; and a coolant jacket integral with said insert and extending over a preponderance of the underside of said upper surface upon which said mold cavities are contained whereby molten metal in said cavities can be solidified by admission of coolant to said insert jacket without cooling said base to a degree impeding the flow of molten metal in said flow channel.

8. A mold assembly according to claim 7 wherein the depth of at least a first one of said mold cavities is greater than at least one other of said mold cavities; and means for preferentially directing coolant to portions of said coolant jacket proximate said first one of said mold cavities.

9. A mold assembly according to claim 8 wherein said insert is a hollow body providing in its hollow interior said coolant jacket and wherein said means for directing coolant is a coolant flow barrier within said hollow interior.

10. A mold assembly according to claim 7 wherein said base frame is free of coolant flow passages.

11. A mold assembly according to claim 7 wherein said horizontal flow channel extends along opposite sides of said base frame and said runoff surface extends along opposite sides of said base frame from said contiguous flow channel portions to the inner margins of the contoured upper surface of said base frame.

12. A mold assembly for casting elements onto storage battery plates comprising a base having a generally horizontal flow channel having an inlet at one end and an outlet at another end for guiding the flow of molten metal; an insert having mold cavities in its upper surface and having a hollow body providing in its hollow interior coolant flow paths and including bosses extending across the thickness of said hollow interior, said bosses having said mold cavities extending from the upper surface of said insert at least partially through the portion of the bosses within said hollow region; said base being a frame having an aperture through its thickness adapted to mount said insert and being separable therefrom; said coolant flow paths in said insert being in close proximity to each of said mold cavities; said base having a large thermal mass whereby molten metal flowing in said flow channel is maintained molten; said insert having a small thermal mass relative to that of said base in the portion thereof defining the walls of the mold cavities whereby molten metal in the mold cavity can be solidified by admission of coolant without cooling said base to a degree impeding the flow of molten metal in said flow channel; and means mounting said insert with an upper surface thereof adjacent said mold cavity in molten metal flow communication with an upper margin of said flow channel whereby the elevation of the level of molten metal in said flow channel to overflow its upper margin will admit the molten metal to said mold cavities and the depression of the level of molten metal following the overflow will establish a level of molten metal in said mold cavity at a level of the upper face of said insert adjacent said mold cavity.

13. A mold assembly according to claim 12 wherein said insert has an upper surface having a thickness above said hollow region and having mold cavities in said thickness whereby coolant in said hollow region is in contact with the bottom walls of said mold cavities.

14. A mold assembly according to claim 12 wherein said bosses have passages from the major face of said insert opposite said upper major face and adapted to receive mold extractors, said mold extractor passages being isolated from said coolant flow paths.

* * * * *